US005190638A

United States Patent [19]

Swan, III et al.

[11] Patent Number: 5,190,638

[45] Date of Patent: Mar. 2, 1993

[54] MOVING BED/FIXED BED TWO STAGE CATALYTIC REFORMING

[75] Inventors: George A. Swan, III; Eduardo Mon, both of Baton Rouge, La.

[73] Assignee: Exxon Research and Engineering Company, Florham Park, N.J.

[21] Appl. No.: 805,348

[22] Filed: Dec. 9, 1991

[51] Int. Cl.[5] ..... C10G 59/02

[52] U.S. Cl. ..... 208/65; 208/63; 208/64

[58] Field of Search ..... 208/65, 64

[56] References Cited

U.S. PATENT DOCUMENTS

| | | | |
|---|---|---|---|
| 3,640,818 | 2/1972 | Hamner | 208/65 |
| 3,748,255 | 7/1973 | Cassidy et al. | 208/65 |
| 3,748,256 | 7/1973 | Ko et al. | 208/65 |
| 3,748,259 | 7/1973 | Cassidy et al. | 208/65 |
| 3,864,240 | 2/1975 | Stone | 208/65 |
| 3,883,418 | 5/1975 | Drehmann | 208/65 |
| 3,992,465 | 11/1976 | Juguin et al. | 208/65 |
| 4,155,843 | 5/1979 | Gallagher | 208/65 |
| 4,167,473 | 9/1979 | Sikonia | 208/64 |
| 4,206,035 | 6/1980 | Hutson, Jr. et al. | 208/65 |
| 4,737,262 | 4/1988 | Franck et al. | 208/65 |
| 4,808,457 | 2/1989 | Nyan | 208/65 |
| 4,832,821 | 5/1989 | Swan, III | 208/65 |
| 4,872,867 | 10/1989 | Clem | 208/65 |
| 4,975,178 | 12/1990 | Chen et al. | 208/65 |
| 4,992,158 | 2/1991 | Schweizer | 208/65 |

*Primary Examiner*—Helane E. Myers
*Attorney, Agent, or Firm*—Henry E. Naylor

[57] ABSTRACT

A two stage process for catalytically reforming a gasoline boiling range hydrocarbonaceous feedstock. The reforming is conducted in two stages wherein the first stage is operated in a moving-bed mode with the catalyst being continually regenerated, and the second stage is operated in a fixed-bed mode.

7 Claims, 1 Drawing Sheet

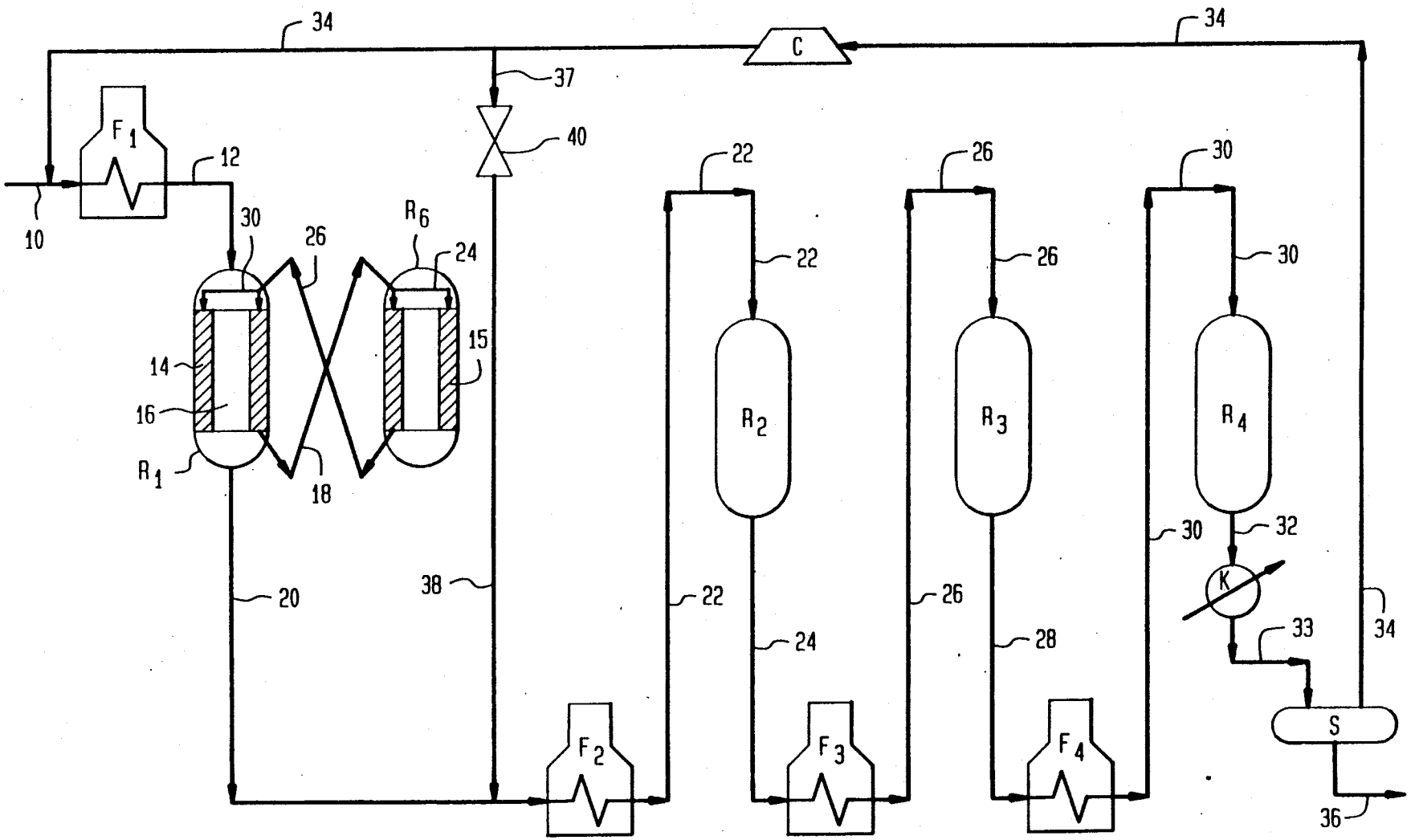
34
C
37
40
34
10
F1
12
30
14
16
R1
26
18
R6
24
15
38
20
22
R2
24
F2
22
26
R3
28
F3
26
30
R4
32
K
33
S
36
F4
30

MOVING BED/FIXED BED TWO STAGE CATALYTIC REFORMING

FIELD OF THE INVENTION

The present invention relates to a two stage process for catalytically reforming a gasoline boiling range hydrocarbonaceous feedstock. The reforming is conducted in two stages wherein the first stage is operated in a moving- bed mode with the catalyst being continually regenerated, and the second stage is operated in a fixed-bed mode.

BACKGROUND OF THE INVENTION

Catalytic reforming is a well established refinery process for improving the octane quality of naphthas or straight run gasolines. Reforming can be defined as the total effect of the molecular changes, or hydrocarbon reactions, produced by dehydrogenation of cyclohexanes, dehydroisomerization of alkylcyclopentanes, and dehydrocyclization of paraffins and olefins to yield aromatics; isomerization of substituted aromatics; and hydrocracking of paraffins which produces gas, and inevitably coke, the latter being deposited on the catalyst. In catalytic reforming, a multifunctional catalyst is usually employed which contains a metal hydrogenation-dehydrogenation (hydrogen transfer) component, or components, usually platinum, substantially atomically dispersed on the surface of a porous, inorganic oxide support, such as alumina. The support, which usually contains a halide, particularly chloride, provides the acid functionality needed for isomerization, cyclization, and hydrocracking reactions.

Reforming reactions are both endothermic and exothermic, the former being predominant, particularly in the early stages of reforming with the latter being predominant in the latter stages. In view thereof, it has become the practice to employ a reforming unit comprised of a plurality of serially connected reactors with provision for heating the reaction stream as it passes from one reactor to another. There are three major types of reforming: semi-regenerative, cyclic, and continuous. Fixed-bed reactors are usually employed in semi-regenerative and cyclic reforming, and moving-bed reactors in continuous reforming. In semi-regenerative reforming, the entire reforming process unit is operated by gradually and progressively increasing the temperature to compensate for deactivation of the catalyst caused by coke deposition, until finally the entire unit is shut-down for regeneration and reactivation of the catalyst. In cyclic reforming, the reactors are individually isolated, or in effect swung out of line, by various piping arrangements. The catalyst is regenerated by removing coke deposits, and then reactivated while the other reactors of the series remain on stream. The "swing reactor" temporarily replaces a reactor which is removed from the series for regeneration and reactivation of the catalyst, which is then put back in the series. In continuous reforming, the reactors are moving-bed reactors, as opposed to fixed-bed reactors, with continuous addition and withdrawal of catalyst. The catalyst descends through the reactor in an annular bed and is passed for regeneration to a regeneration zone and the regenerated catalyst returned to the reaction zone.

With the gradual phasing out of lead from the gasoline pool and with the introduction of premium grade lead-free gasoline in Europe and the United States, petroleum refiners must re-evaluate how certain refinery units are run to meet this changing demand for higher octane fuel without the use of lead. Because catalytic reforming units produce product streams which represent the heart of the gasoline pool, demands are being put on these units for generating streams with ever higher octane ratings.

U.S. Pat. No. 3,992,465 teaches a two stage reforming process wherein the first stage is comprised of at least one fixed-bed reforming zone and the second stage is comprised of a moving-bed reforming zone. The teaching of U.S. Pat. No. 3,992,465 is primarily to subject the reformate, after second stage reforming to a series of fractionations and an extractive distillation of the $C_6$–$C_7$; cut to obtain an aromatic-rich stream.

While the above-referenced process schemes are designed to take advantage of various process features, there is still a need for reforming process schemes which can generate more hydrogen. There is also a need in the art for the modification of existing fixed-bed reforming units to incorporate some of the advantages of moving-bed reforming units, without having to build an entirely new grass-roots moving-bed unit. The process scheme of the present invention is one which will generate substantial amounts of hydrogen, particularly in the first stage.

SUMMARY OF THE INVENTION

In accordance with the present invention, there is provided a process for catalytically reforming a gasoline boiling range hydrocarbon reactant stream in the presence of hydrogen in a reforming process unit comprised of a plurality of serially connected reforming zones wherein each of the reforming zones contains a reforming catalyst comprised of one or more Group VIII noble metals on a refractory support. The catalyst may be either monofunctional or bifunctional. The process comprises:

(a) reforming the reactant stream in a first reforming stage which is comprised of one or more reforming zones which operate in a moving-bed continuous catalyst regeneration mode wherein the catalyst is comprised of one or more Group VIII noble metals on substantially spherical support particles, which catalyst descends through the reforming zone, exits, and is passed to a regeneration zone where at least a portion of the accumulated carbon is burned-off, and wherein the regenerated catalyst is recycled back to the one or more reforming zones;

(b) passing the partially reformed reactant stream into a second reforming stage comprised of one or more serially connected reforming zones containing a fixed-bed of catalyst comprised of one or more Group VIII noble metals, which one or more reforming zones is operated at reforming conditions which includes a pressure of about 100 to 500 psig, thereby producing a reformate of at least 95 RON clear.

In preferred embodiments, the Group VIII noble metal for catalysts in all stages is platinum.

In still other preferred embodiments of the present invention, the catalyst of the first stage is comprised of platinum and tin on a spherical alumina support material.

BRIEF DESCRIPTION OF THE FIGURE

The sole figure hereof depicts a simplified flow diagram of a preferred reforming process of the present invention. The reforming process unit is comprised of a first stage which includes a reactor in fluid communication with a regenerative zone, which reactor is an annular radial flow reactor wherein the catalyst continually descends through the reactor and is transported to the regeneration zone, then back to the reactors, etc. The second stage is a series of fixed-bed reactors which are operated in semi-regenerative mode.

DETAILED DESCRIPTION OF THE INVENTION

Feedstocks, also sometimes referred to herein as reactant streams, which are suitable for reforming in accordance with the instant invention are any hydrocarbonaceous feedstocks boiling in the gasoline range. Nonlimiting examples of such feedstocks include the light hydrocarbon oils boiling from about 70° F. to about 500° F., preferably from about 180° F. to about 400° F., for example straight run naphthas, synthetically produced naphthas such as coal and oil-shale derived naphthas, thermally or catalytically cracked naphthas, hydrocracked naphthas, or blends or fractions thereof.

Referring to the sole Figure hereof, a gasoline boiling range hydrocarbon reactant stream, which is preferably first hydrotreated by any conventional hydrotreating method to remove undesirable components such as sulfur and nitrogen, is passed to a first reforming stage represented by heater, or preheat furnace $F_1$, reforming zone $R_1$, and regeneration zone RG. A reforming stage, as used herein, is comprised of any one or more reforming zones of the same type, in this figure reactors, and its associated equipment (e.g., preheat furnaces, etc.). That is, a reforming zone will be comprised on one or more fixed-bed reactors or moving-bed reactors, but not both. The reactant stream is fed into heater, or preheat furnace, $F_1$, via line 10 where it is heated to an effective reforming temperature. That is, to a temperature high enough to initiate and maintain dehydrogenation reactions, but not so high as to cause excessive hydrocracking. The heated reactant stream is then fed, via line 12, into reforming zone $R_1$ which contains a catalyst suitable for reforming. Reforming zone $R_1$, is operated in a continuous moving bed mode. The reforming catalyst charged to reforming zone $R_1$ is comprised of at least one Group VIII noble metal, preferably platinum; and one or more promoter metals, preferably tin, on spherical particles of a refractory support, preferably alumina. The spherical particles have an average diameter of about 1 to 3 mm, preferably about 1.5 to 2 mm, the density in bulk of this solid being from about 0.5 to 0.9 and more particularly from about 0.5 to 0.8.

Moving-bed reforming zones, or reactors, are well known in the art and is typical of those taught in U.S. Pat. Nos. 3,652,231; 3,856,662; 4,167,473; and 3,992,465 which are incorporated herein by reference. Reforming conditions for the moving-bed reforming zones will include temperatures from about 800° to 1200° F., preferably from about 800° to 1000° F.; pressures from about 30 to 300, preferably from about 50 to 150 psig; a weight hourly space velocity from about 0.5 to 20, preferably from about 0.75 to 6. Hydrogen-rich gas should be provided to maintain the hydrogen to oil ratio between the range of about 0.5 to 5, preferably from about 0.75 to 3. The general principle of operation of such a reforming zones is that the catalyst is contained in a annular bed formed by spaced cylindrical screens. The reactant stream is processed through the catalyst bed, typically in an out-to-in radial flow, that is, it enters the reactor at the top and flows radially from the reactor wall through the annular bed of catalyst 14, which is descending the reactor and into the cylindrical space 16 created by said annular bed. It exits the bottom of the reforming zone and is passed, via line 20, to furnace $F_2$, then to reforming zone $R_2$ via line 22, which is the first reforming zone of the second stage reforming.

The catalyst of reforming zone $R_1$ is continuously moved through the reforming zone and to regeneration zone RG via line 18 and transfer conduits 24 where it is distributed in the annular moving bed 25 where accumulated carbon is burned-off at conventional conditions as the bed of catalyst moves through the regeneration zone. The catalyst regeneration zone RG represents all of the steps required to remove at least a portion of the carbon from the catalyst and return it to the state needed for the reforming reactions occurring in reforming zone $R_1$. The specific steps included in RG will vary with the selected catalyst. The only required step is one where accumulated carbon is burned-off at temperatures from about 600° to 1200° F. and in the presence of an oxygen-containing gas, preferably air. Additional steps which may also be contained in the catalyst regeneration equipment represented by RG include, but are not limited to, adding a halide to the catalyst, purging carbon oxides, redispersing metals, and adding sulfur or other compounds to lower the rate of cracking when the catalyst first enters the reforming zone.

The regenerated catalyst is then recharged to reforming zone $R_1$ via line 26 through transfer conduit 30 where it is distributed in the annular moving bed of catalyst 14. This cycle is continued until the entire unit is shut-down for regeneration of the catalysts of the reforming zones in the second stage reforming.

Returning now to the flow of the reaction stream, the stream is passed to reforming zone $R_2$ via line 22 from furnace $F_2$. As previously mentioned, reforming zone $R_2$ represents the first reforming zone in the second reforming stage. All o& the reforming zones of this second stage are operated in a fixed-bed catalyst mode. While there may only be one reforming zone in this second stage, it is preferred that there by two or three, more preferably three. The reaction stream leaves reforming zone $R_2$ and is passed via line 24 to furnace $F_3$, then to reforming zone $R_3$ via line 26. The reactant stream leaves reforming zone $R_3$ via line 28 and is passed to furnace $F_4$ then to reforming zone $R_4$ via line 30. The reaction stream is then passed via line 32 to cooling zone K to condense the liquid to a temperature within the operating range of the recycle gas separation zone S, which is represented by a separation drum. The temperature will generally range from about 60° to about 300° F., preferably from about 80° to about 125° F. The cooled effluent stream is then fed to separation zone S via line 33 where a lighter gaseous stream and a heavier liquid stream are produced. The gaseous stream is a hydrogen-rich predominantly $C_4-$ gaseous fraction which is recycled via line 34 to first reforming stage by first passing it through compressor C to bring its pressure up to inlet process pressure. A predominantly $C_5+$ liquid stream is collected from separation zone S via line 36. The preferred separation would result in a hydrogen-rich predominantly $C_4-$ gaseous stream and a predominantly $C_5+$ liquid stream. It is understood that these streams are not pure streams. For example, the separation zone will not provide complete separation between the $C_4-$ components and the $C_5+$ liquids. Thus, the gaseous stream will contain minor amounts of $C_5+$ components and the liquid stream will contain minor amounts of $C_4-$ components and hydrogen.

A portion of the hydrogen-rich recycle gas may by pass first stage reforming and be sent via line 38 through pressure control valve 40 to line 20 for recycle to second stage reforming. Up to about 20 vol. % of the hydrogen-rich stream may by-pass the first reforming stage. This will reduce the overall hydrogen pressure in the first stage which can result in increased hydrogen production, but at the cost of increased coking of the catalyst. Of course, a balance needs to be struck between how much additional hydrogen can be produced at the cost of catalyst coking. It may also be desirable to run the reforming unit of the present invention without any hydrogen-rich by-pass.

Reforming zone $R_1$ as well any other reforming zone of the first stage, is operated at reforming conditions for moving-bed reforming reactors. Typical reforming operating conditions for such reactors include temperatures of about 800° to about 1000° F., pressures from about 100 psig to about 500 psig, preferably from about 150 psig to about 300 psig; a weight hourly space velocity (WHSV) of about 0.5 to about 20, preferably from about 1.0 to about 15 and a hydrogen to oil ratio of about 0.5 to 10 moles of hydrogen per mole of $C_5+$ feed, preferably 0.75 to 3 moles of hydrogen per mole of $C_5+$ feed. The reforming conditions of the fixed-bed reactors of the second stage will be run at the above conditions except that the temperatures can range from about 800° to about 1200° F. to about 800° to 1000° F.

The moving-bed zones of the first stage may be arranged in series, side-by-side, each of them containing a reforming catalyst bed slowly flowing downwardly, as mentioned above, either continuously or, more generally, periodically, said bed forming an uninterrupted column of catalyst particles. The moving bed zones may also be vertically stacked in a single reactor, one above the other, so as to ensure the downward flow of catalyst by gravity from the upper zone to the next below. The reactor then consists of reaction zones of relatively large sections through which the reactant stream, which is in a gaseous state, flows from the periphery to the center or from the center to the periphery interconnected by catalyst zones of relatively small sections, the reactant stream issuing from one catalyst zone of large section may be divided into a first portion (preferably from 1 to 10%) passing through a reaction zone of small section for feeding the subsequent reaction zone of large section and a second portion (preferably from 99 to 90%) sent to a thermal exchange zone and admixed again to the first portion of the reactant stream at the inlet of the subsequent catalyst zone of large section.

When using one or more reaction zones with a moving bed of catalyst, said zones as well as the regeneration zone, are generally at different levels. It is therefore necessary to ensure several times the transportation of the catalyst from one relatively low point to a relatively high point, for example from the bottom of a reaction zone to the top of the regeneration zone, said transportation being achieved by any lifting device simply called "lift". The fluid of the lift used for conveying the catalyst may be any convenient gas, for example nitrogen or still for example hydrogen and more particularly purified hydrogen or recycle hydrogen.

Catalysts suitable of use in any of the reactors of any of the stages include both monofunctional and bifunctional, monometallic and multimetallic noble metal containing reforming catalysts. Preferred are the bifunctional reforming catalysts comprised of a hydrogenation-dehydrogenation function and an acid function. The acid function, which is important for isomerization reactions, is thought to be associated with a material of the porous, adsorptive, refractory oxide type which serves as the support, or carrier, for the metal component, usually a Group VIII noble metal, preferably Pt, to which is generally attributed the hydrogenation-dehydrogenation function. The preferred support for both stages of reforming is an alumina material, more preferably gamma alumina. It is understood that the support material for the moving-bed reforming zone will be in the form of spherical particles as previously described. One or more promoter metals selected from metals of Groups IIIA, IVA, IB, VIB, and VIIB of the Periodic Table of the Elements may also be present. The promoter metal, can be present in the form of an oxide, sulfide, or in the elemental state in an amount from about 0.01 to about 5 wt. %, preferably from about 0.0 to about 3 wt. %, and more preferably from about 0.2 to about 3 wt. %, calculated on an elemental basis, and based on total weight of the catalyst composition. It is also preferred that the catalyst compositions have a relatively high surface area, for example, about 100 to 250 $m^2/g$. The Periodic Table of which all the Groups herein refer to can be found on the last page of Advanced Inorganic Chemistry, 2nd Edition, 1966, Interscience publishers, by Cotton and Wilkinson.

The halide component which contributes to the necessary acid functionality of the catalyst may be fluoride, chloride, iodide bromide, or mixtures thereof. Of these, fluoride, and particularly chloride, are preferred. Generally, the amount of halide is such that the final catalyst composition will contain from about 0.1 to about 3.5 wt. %, preferably from about 0.5 to about 1.5 wt. % of halogen calculated on an elemental basis.

Preferably, the platinum group metal will be present on the catalyst in an amount from about 0.01 to about 5 wt. %, calculated on an elemental basis, of the final catalytic composition. More preferably, the catalyst comprises from about 0.1 to about 2 wt. % platinum group component, especially about 0.1 to 2 wt. % platinum. Other preferred platinum group metals include palladium, iridium, rhodium, osmium, ruthenium and mixtures thereof.

This process provides high hydrogen and $C_5+$ liquid yields by operating the first stage at more severe conditions of higher temperatures and lower hydrogen to oil ratios than is possible with a fixed-bed reforming zone or zones without continuous catalyst regeneration. By addition of a first moving-bed stage to an existing fixed-bed reforming unit, hydrogen production may be enhanced without a major increase in product octane. Furthermore, unit pressure may be reduced without substantially increasing catalyst deactivation rate in the fixed-bed reactors of the second stage.

Various changes and/or modifications, such as will present themselves to those familiar with the art may be made in the method and apparatus described herein without departing from the spirit of this invention whose scope is commensurate with the following claims.

What is claimed is:

1. A process for catalytically reforming a gasoline boiling range hydrocarbon reactant stream in the presence of hydrogen in a reforming process unit comprised of a plurality of serially connected reforming zones wherein each of the reforming zones contains a reforming catalyst comprised of one or more Group VIII noble metals on a refractory support, which process comprises:

(a) reforming the reactant stream in a first reforming stage which is comprised of one or more reforming zones which are operated in a moving-bed continuous catalyst regeneration mode wherein the catalyst is comprised of one or more Group VIII noble metals on substantially spherical support particles, which catalyst descends through the reforming zone, exits, and is passed to a regeneration zone where at least a portion of the accumulated carbon is burned-off, and wherein the regenerated catalyst is recycled back to the one or more reforming zones;

(b) passing the partially reformed reactant stream into a second reforming stage comprised of one or more serially connected reforming zones containing a fixed-bed of catalyst comprised of one or more Group VIII noble metals, which one or more reforming zones is operated at reforming conditions which includes a pressure of about 100 to 500 psig, thereby producing an effluent stream of at least 96 RON clear.

2. The process of claim 1 wherein the catalyst of the first reforming stage is comprised of about 0.01 to 5 wt. % platinum, 0.01 to 5 wt. % tin, on substantially spherical particles of a refractory support.

3. The process of claim 2 wherein the amount of platinum and tin are each from about 0.1 to 2 wt. % and the spherical refractory support particles are comprised of alumina.

4. The process of claim 1 wherein the catalyst in each of the second stage reforming zones is comprised of about 0.01 to 5 wt. % platinum, and about 0.01 to 5 wt. % of at least one metal selected from the group consisting of iridium, rhenium, and tin.

5. The process of claim 3 wherein the catalyst in each of the second stage reforming zones is comprised of about 0.01 to 5 wt. % platinum, and about 0.01 to 5 wt. % of at least one metal selected from the group consisting of iridium, rhenium, and tin.

6. The process of claim 1 wherein a portion of the hydrogen-rich recycle stream is made to by-pass first stage reforming and is passed directly to second stage reforming.

7. The process of claim 6 wherein: (i) the catalyst in each of the first stage reforming zones is comprised of about 0.1 to 2 wt. % platinum, and about 0.1 to 2 wt. % tin on substantially spherical refractory support: and (ii) the catalyst in each of the second stage reforming zones is comprised of about 0.01 to 5 wt. % platinum, and about 0.01 to 5 wt. % of at least one metal selected from the group consisting of iridium, rhenium, and tin.

* * * * *